US007236183B2

(12) United States Patent
O'Hara et al.

(10) Patent No.: US 7,236,183 B2
(45) Date of Patent: Jun. 26, 2007

(54) PRINTHEAD WITH VARIABLE EXPOSURE WIDTH

(75) Inventors: Shawn E. O'Hara, Rochester, NY (US); Denis P. Reilly, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 271 days.

(21) Appl. No.: 11/012,977

(22) Filed: Dec. 15, 2004

(65) Prior Publication Data

US 2005/0140773 A1 Jun. 30, 2005

Related U.S. Application Data

(60) Provisional application No. 60/532,288, filed on Dec. 23, 2003.

(51) Int. Cl.
*B41J 2/47* (2006.01)
*B41J 2/435* (2006.01)

(52) U.S. Cl. ..... 347/237; 347/247

(58) Field of Classification Search ..... 347/237, 347/247, 238, 12; 358/1.3
See application file for complete search history.

(56) References Cited

U.S. PATENT DOCUMENTS

| | | | | |
|---|---|---|---|---|
| 4,746,941 | A | 5/1988 | Pham et al. | |
| 5,126,759 | A | 6/1992 | Small et al. | |
| 5,253,934 | A * | 10/1993 | Potucek et al. | 347/237 |
| 5,805,197 | A * | 9/1998 | Fleming et al. | 347/237 |
| 5,828,400 | A * | 10/1998 | Fleming | 347/238 |
| 5,859,657 | A * | 1/1999 | Donahue et al. | 347/237 |
| 5,926,201 | A * | 7/1999 | Fleming et al. | 347/237 |
| 7,101,007 | B2 * | 9/2006 | Hayasaki | 347/12 |
| 2002/0154321 | A1 | 10/2002 | Pham et al. | |

* cited by examiner

*Primary Examiner*—Hai Pham
*Assistant Examiner*—Carlos A. Martinez, Jr.
(74) *Attorney, Agent, or Firm*—Lawrence P. Kessler

(57) ABSTRACT

A printhead with a variable exposure width having a plurality of exposure elements defining a given exposure width. A plurality of driver ICs are coupled to the exposure elements, each driver IC including a plurality of registers. A data bus is coupled to the plurality of driver ICs. Circuitry is provided in a first driver IC of the plurality of driver ICs for having data received from the data bus bypass the plurality of registers in the first driver IC to disable unused exposure elements of the plurality of exposure elements, whereby the exposure width can be varied from the given width, and data loading bandwidth is minimized.

9 Claims, 3 Drawing Sheets

PRINTHEAD WITH VARIABLE EXPOSURE WIDTH

CROSS REFERENCE TO RELATED APPLICATION

Reference is made to and priority claimed from U.S. Provisional Application Ser. No. 60/532,288, filed Dec. 23, 2003, entitled A METHOD FOR TESTING A PLASTIC SLEEVE FOR AN IMAGE CYLINDER OR A BLANKET CYLINDER.

FIELD OF THE INVENTION

The present invention is directed to electronic digital printing devices. More particularly, the present invention is directed to an electronic printhead having a variable exposure width.

BACKGROUND OF THE INVENTION

Many electronic digital printers apply print characters to paper via multiple exposure elements of an exposure device. In some printers, such as the NexPress 2100 from NexPress Solutions LLC, the exposure elements are light emitting diodes ("LEDs") and the exposure device is an LED printhead.

The LEDs are typically controlled by a printhead driver integrated circuit ("IC"). Each driver IC may control many LEDs, and a printer may include multiple driver ICs.

Known LED printhead assemblies and other types of printheads typically having a "fixed width" architecture, meaning that a unique substrate assembly is designed to match the product exposure width requirements. With the known printheads, for every line of exposure, all of the LED driver ICs populated on the substrate must be reloaded for every line of exposure. Specifically, the data register for each LED element must be resent data for each and every line of exposure. Intended "off" LEDs must be loaded with a zero data value for each line. In many applications, certain LEDs at the ends of an LED printhead are not used and must be continually loaded with zero data. This redundant operation to load unused LEDs with zero data wastes a significant amount of data loading bandwidth and therefore limits the speed of the printing device.

Since known LED printheads are a fixed width they tend to be used for specific products. It is not practical to use a wider LED printhead for narrower product applications due to-unnecessary data loading and bandwidth loss.

Fixed width does not allow for running a reduced image area at a higher speed without increasing the data rate of flow. Known LED image path driving systems can easily be adapted to a change in the amount of data sent, but cannot easily increase the speed at which the data is sent.

FIG. 1 is a block diagram of a prior art fixed width printhead. Printhead 10 is formed from a string of LEDs 18. Printhead 10 has a fixed width 12 based on the entire string of LEDs 18. For an image area requirement 14, some of the LEDs form unused areas 16 and 17. However, unused areas 16, 17 still must be loaded with zero data for each and every line of exposure. As discussed, this reduces the speed of the printing device.

Based on the foregoing, there is a need for a flexible printhead in which unused portions can be turned off or disabled.

SUMMARY OF THE INVENTION

The present invention is a driver IC for an electronic printhead with variable exposure width. The driver IC includes a plurality of registers corresponding to exposure elements and a token input. The driver IC further includes circuitry coupled to the registers. The circuitry is adapted to bypass received data from the registers in response to a token received from the token input.

By bypassing sections of unused areas, the overall speed of the printhead can be increased. This improves data bandwidth and also data robustness since less data needs to be sent.

DETAILED DESCRIPTION OF THE INVENTION

One embodiment of the present invention is a flexible width LED printhead that allows for a variable printhead imaging width by disabling unused LEDs.

Figure 1:
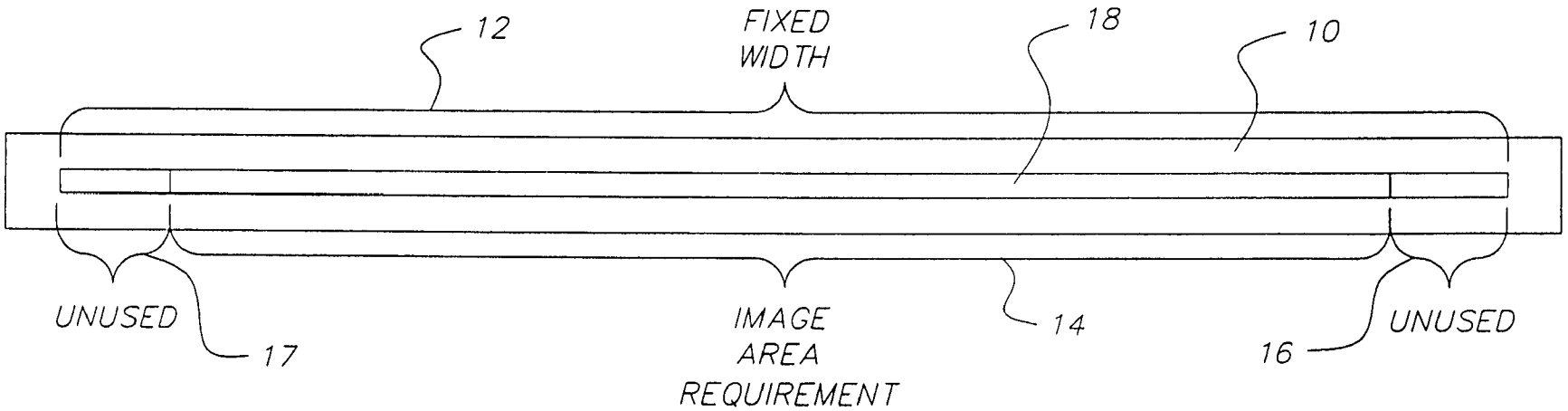
(PRIOR ART) FIG. 1
FIG. 1 is a block diagram of a prior art fixed width printhead.
Figure 2:
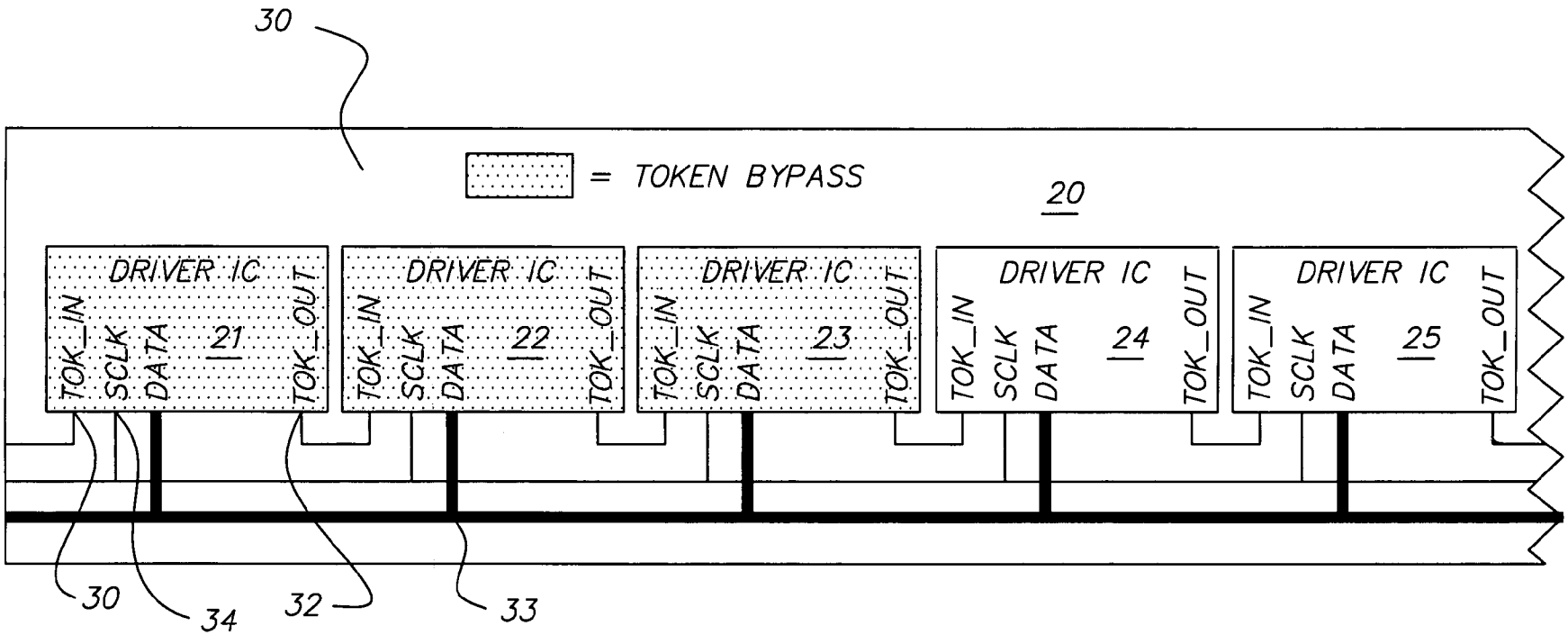
FIG. 2 is a block diagram of a portion of an LED printhead board illustrating one embodiment of the present invention.

FIG. 2 is a block diagram of a portion of an LED printhead board 20 illustrating one embodiment of the present invention. Printhead board 20 includes a substrate 30 and a string of driver ICs 21-25 mounted on substrate 30. Each driver IC 21-25 is coupled to LEDs (not shown) or other types of exposure elements. In other embodiments, printhead board 20 will include more than five driver ICs, depending on the desired width of the printhead. In one embodiment, each driver IC on board 20 is coupled to 96 LEDs, and each driver IC is approximately ⅓ inch long.

In one embodiment, each driver IC 21-25 includes a token input 31, a token output 32, a clock input ("SCLK") 34, and a data input/output bus 33. Data bus 33 maybe at the "front" of the driver ICs, as shown in FIG. 2, or it may be on the side of the driver ICs. In one embodiment, a token is one or more digital bits or any type of signal that can toggle between multiple values.

Data is initially received by a driver IC at an end of the string of driver ICs 21-25, and is passed to the other driver ICs in a serial fashion using token control. Token control is a direction control of data loading inside the driver ICs. Data for multiple exposure elements is passed from right to left or from left to right in a serial fashion along the string of driver ICs 21-25 so that multiple exposure element registers can be loaded by one external data bus (e.g., data bus 33). The token shifts by one element on every clock transition.

One embodiment of the present invention bypasses selective driver ICs on the string of driver ICs 21-25 from receiving data to reduce the exposure width of the printhead. For example, in FIG. 2 driver ICs 21-23 are bypassed in one embodiment. In one embodiment, a "token bypass" function, which involves transmitting a bypass token among the driver ICs, is used to bypass selective driver ICs.

When no driver ICs are bypassed, as in the prior art and embodiments of the present invention when the entire exposure width of the printhead is used, data is presented to the input data bus and serially loaded into the multiple LED registers of each driver IC using the token and clock signals. When the input token is activated at a particular driver IC, each clock edge latches the LED data to the input data register and passes token control to the next register. When the last LED clock or token advancement is received and data is latched, the token is passed out of the driver IC token output signal to the next driver IC token input signal.

In contrast, the token bypass function in accordance with one embodiment of the present invention bypasses the whole driver IC token/input data register-loading portion. When token bypass is activated the input token signal is passed through a single flip-flop to the token output pad. The token passing latency through the driver IC is only one clock period. When token bypass is activated, no input LED registers are loaded.

FIG. 2 illustrates the token bypass operation in which driver ICs 21-23 are desired to be bypassed because, for example, the LEDs associated with those driver ICs are part of an unused exposure area of the printhead. The token bypass bit is enabled for those three driver ICs. When the driver ICs are bypassed it is not necessary to supply multiple clocks and multiple zero data into driver IC 21, then driver IC 22 then driver IC 23 before loading the first desired driver IC, driver IC 24 (assuming a left to right loading of data). Instead, only one clock period per bypassed driver IC is required and data begins loading into driver IC 24 on the fourth clock period. Since some LED driver ICs typically include of up to 100 or more LED elements and driving circuits, this produces significant time reduction of data loading in order to arrive at a desired starting printing point. Further, the starting point is easily changeable by software making active operating exposure width changes easy to perform.

Figure 3:
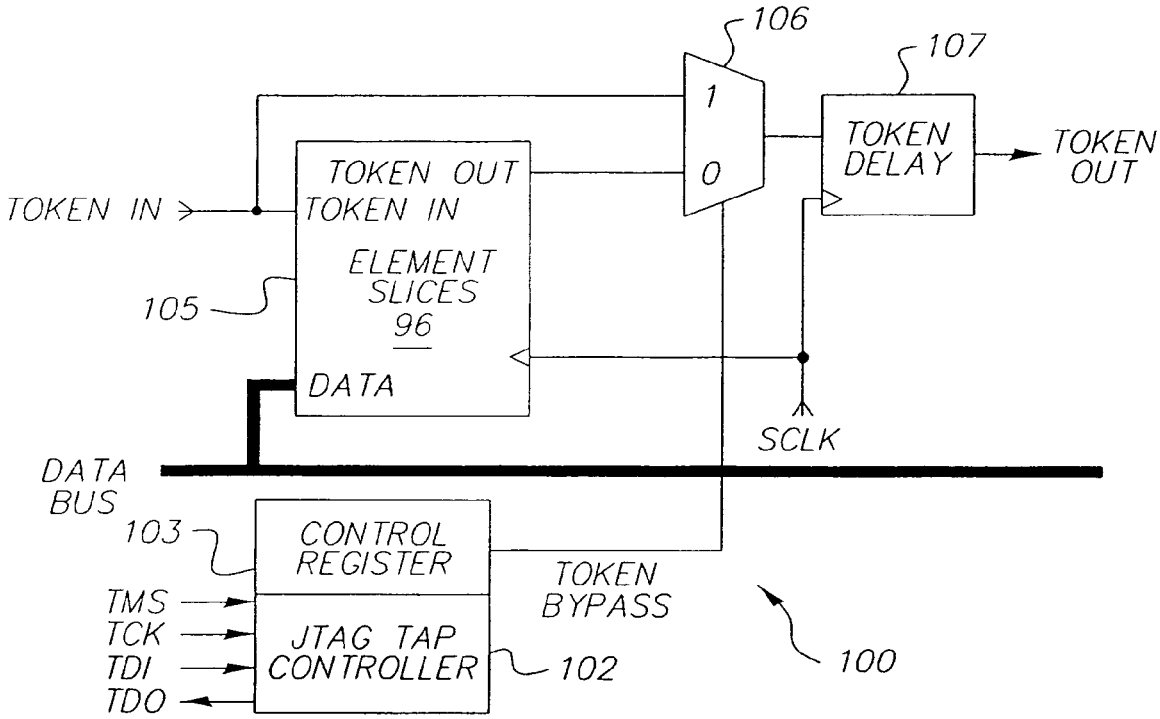
FIG. 3 is a circuit diagram of circuitry that performs the token bypass function in each driver IC in accordance with one embodiment of the present invention.

In one embodiment, each driver IC 21-25 includes circuitry for performing the token bypass function. FIG. 3 is a circuit diagram of circuitry 100 that performs the token bypass function in each driver IC in accordance with one embodiment of the present invention. Circuitry 100 includes Joint Test Action Group ("JTAG") Tap controller 102 and a JTAG control register 103. JTAG TAP controller 102 can be a standard JTAG compliant controller used for accessing JTAG control register 103 in accordance with the JTAG IEEE 1149.1 boundary scan standard. Control register 103 may be a standard JTAG register and its purpose is to enable or disable the token bypass function.

In one embodiment, bit-0 of control register 103 activates the token bypass feature. When set to zero the token bypass is not enabled, the loading data flows into the driver IC within LED registers 105 (i.e., one register per each exposure element) until all LED registers are filled on clock edges (SCLK), then the token signal is passed out to the token output through a selector 106 and a token delay flip-flop 107 for use by the next connected driver IC connected. When bit-0 of control register 103 is set to one the token bypass function is enabled, the data and token signal bypasses LED registers 105 and the token signal exits the driver IC at delay flip-flop 107 one clock edge later.

In other embodiments, the circuitry of FIG. 3 can be duplicated in multiple sections within a driver IC to allow finer resolution of the bypass areas. For example, a portion of the LEDs on a single driver IC can be bypassed.

As disclosed, embodiments of the present invention allow driver ICs in a string of driver ICs to be bypassed from the data loading process. This allows software adjustment of the active exposure area and allows flexibility of active exposure width, making one printhead device compatible for multiple width situations (e.g., multiple end products).

By bypassing sections of unused areas, the overall speed of a printhead can be increased. This improves data bandwidth and also data robustness since less data needs to be sent.

In addition, embodiments of the present invention allow widths smaller than the total width to be operated at higher speed since less data is required. Higher speed modes can be achieved by shrinking the active area. For example, paper one-half in size to the overall printhead maximum width can be run at twice the speed by bypassing one-half the driver ICs.

Further, production scanning and testing times can be lowered. Driver ICs that are not being scanned or tested can be bypassed. By only enabling the desired driver ICs under test, significantly lower amounts of data need to be sent during the data-loading phase.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed is:

1. A printhead with a variable exposure width, said printhead comprising:

a plurality of exposure elements defining a given exposure width;

a plurality of driver ICs coupled to said exposure elements, each driver IC including a plurality of registers;

a data bus coupled to the plurality of driver ICs; and circuitry in a first driver IC of said plurality of driver ICs for having data received from said data bus bypass the plurality of registers in the first driver IC to disable unused exposure elements of said plurality of exposure elements, whereby the exposure width can be varied from said given width, and data loading bandwidth is minimized.

2. The printhead of claim 1, wherein said circuitry bypasses the registers based on a received token.

3. The printhead of claim 2, wherein the token is a signal indicating a selection of bypass or no bypass.

4. The printhead of claim 1, wherein the exposure elements are light emitting diodes (LEDs), and the registers comprise a single register per LED.

5. The printhead of claim 1, wherein said circuitry comprises a Joint Test Action Group (JTAG) tap controller.

6. The printhead of claim 5, wherein said circuitry comprises a selector coupled to a flip-flop.

7. A method of operating a printhead having a plurality of exposure elements coupled to a plurality of driver ICs, said method comprising:

determining which of the exposure elements are required for a desired printing width;

generating a bypass signal for each of the driver ICs corresponding to the exposure elements not required; and loading only data for those driver ICs required to be activated for a desired printing width.

8. The method of claim 7, wherein each of the driver ICs comprise a plurality of registers, said method further comprising;

receiving a first token signal at a first driver IC; and preventing printer data to be stored in first registers of the first driver IC in response to the received first token signal.

9. The method of claim 8, wherein the preventing comprises sending the token signal through a selector and a flip-flop.

* * * * *